US005487658A

United States Patent [19]

Lee

[11] Patent Number: 5,487,658

[45] Date of Patent: Jan. 30, 1996

[54] SAFETY DEVICE FOR NOVELTY CANDLE HOLDERS

[76] Inventor: Seung-Soo Lee, 808 Pony Trail, Franklin Lakes, N.J. 07417

[21] Appl. No.: 306,109

[22] Filed: Sep. 14, 1994

Related U.S. Application Data

[63] Continuation-in-part of Ser. No. 37,302, Mar. 26, 1993, Pat. No. 5,363,590.

[51] Int. Cl.[6] ..... F23D 3/16

[52] U.S. Cl. ..... 431/253; 431/289; 431/292; 431/297

[58] Field of Search ..... 431/253, 284, 431/292, 297, 291

[56] References Cited

U.S. PATENT DOCUMENTS

| | | | |
|---|---|---|---|
| 1,336,635 | 4/1920 | Knapp | 431/291 |
| 2,111,642 | 3/1938 | Saier | 431/297 |
| 2,750,775 | 6/1956 | Robertson et al. . | |
| 2,775,882 | 1/1957 | Doig | 431/289 |
| 2,888,816 | 6/1959 | Kanost . | |
| 3,071,952 | 1/1963 | Churchill . | |
| 4,186,430 | 1/1980 | Britton . | |
| 4,477,249 | 10/1984 | Ruzek et al. . | |
| 4,568,269 | 2/1986 | Lin . | |
| 4,721,455 | 1/1988 | Barfus . | |
| 4,759,699 | 7/1988 | Rubarth . | |
| 4,804,323 | 2/1989 | Kim . | |
| 5,015,175 | 5/1991 | Lee . | |
| 5,129,159 | 7/1992 | Fuenzalida . | |
| 5,193,994 | 3/1993 | Schirneker | 431/289 |
| 5,363,590 | 11/1994 | Lee | 431/253 |

FOREIGN PATENT DOCUMENTS

| | | | |
|---|---|---|---|
| 59046 | 2/1891 | Germany | 431/292 |
| 332901 | 2/1920 | Germany | 431/293 |
| 813686 | 7/1951 | Germany | 431/293 |
| 18491 | of 1889 | United Kingdom | 431/289 |

*Primary Examiner*—Carroll B. Dority

[57] ABSTRACT

There is provided in accordance with the present invention a safety device for a candle-flame activatable electronic device having a candle holding section. The safety device comprises a nonflammable hollow structure which has an inner surface and an outer surface, wherein the hollow structure is intimately place atop of the candle holding section and the contour of the inner surface of the hollow structure conforms to the circumferential contour of the candle.

14 Claims, 1 Drawing Sheet

SAFETY DEVICE FOR NOVELTY CANDLE HOLDERS

CROSS-REFERENCE TO RELATED APPLICATION

This application is a continuation-in-part of U.S. Ser. No. 08/037,302, filed on Mar. 26, 1993, and now U.S. Pat. No. 5,363,590.

BACKGROUND OF THE INVENTION

The present invention relates to a safety device for candle-flame activatable devices that are equipped with a candle. The safety device extinguishes the candle flame when it reaches a predetermined position of the candle.

Decorative candles are widely used to enhance festive moods of various commemorative occasions such as birthday parties, holiday gatherings and various anniversaries. Although the flame of a candle may enhance the mood of festive occasions, the flame can create fire hazards by igniting flammable materials in its surrounding if the lit candle is unattended and left to burn. Other popular articles that are frequently used to enhance the mood of festive occasions are small electronic sound emitting devices that produce audible sounds, e.g., simple musical melodies and/or vocal messages, when activated. Typically, these electronic sound emitting devices are packaged in an inexpensive plastic or paper container since these devices are designed to be disposable.

Recently, a number of party articles combining a candle and an electronic sound-emitting device are introduced in the market. The combined structure of a candle and a candle-flame activatable sound-emitting electronic device in general is hereinafter referred to as a musical candle. These party articles, in general, produce audible sounds when the candle is lit. These combination devices are highly entertaining since they provide both audio and visual effects. However, the combination of a candle and an electronic device further exacerbates the fire hazard problem in that the electronic device not only is typically packaged in a flammable material but also contains a battery that may explode upon exposure to heat.

Consequently, there is a need for a safety device that ensures the extinction of the candle flame when it reaches a predetermined position.

SUMMARY OF THE INVENTION

There is provided in accordance with the present invention a safety device for a candle-flame activatable electronic device having a candle holding section. The safety device comprises a nonflammable elongated hollow structure which has an inner surface and an outer surface, wherein the hollow structure is intimately place atop of the candle holding section of the electronic device and the contour of the inner surface of the hollow structure conforms to the circumferential contour of the candle. Additionally provided is a safety device for a candle-flame activatable electronic device having a candle holding section that holds a candle. The safety device comprises a nonflammable elongated hollow structure which has an upper section and an lower section, the upper and lower sections having an inner surface and an outer surface, wherein the contour of the inner surface of the upper section conforms to the circumferential contour of the candle and the contour of the inner or outer surface of said lower section conforms to the outer or inner, respectively, circumferential contour of said candle holding section. The term "elongated hollow structure" as used herein indicates a tube-like elongated hollow structure that has two opened ends. The term "nonflammable" as used herein indicates the condition that does not burn under the highest temperature produced by a burning candle. Alternatively stated, a nonflammable material maintains its physical integrity and does not burn when exposed to the burning flame of a candle.

The safety device of the present invention extinguishes the candle flame when the flame reaches the safety device, thereby preventing the flame from burning the electronic device and/or overheating the battery contained in the electronic device.

DETAILED DESCRIPTION OF THE PREFERRED EMBODIMENT

Figure 1:
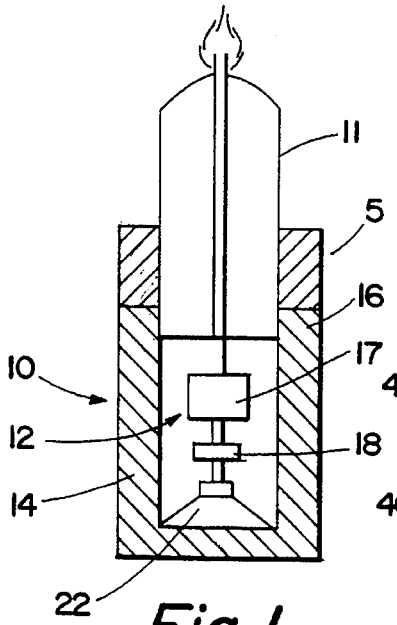
FIGS. 1–6 illustrates exemplary safety devices of the present invention, which are fitted to a musical candle.

The present invention provides a safety device for a candle-flame activatable electronic device. FIG. 1 illustrates an exemplary candle-flame activatable electronic device 10 that is fitted with a candle 11. The electronic device 10 is equipped with a safety device 5 of the present invention. The candle-flame activatable electronic device 10 comprises an electronic circuit assembly 12 and a housing 14. The housing 14 has a candle holding section 16, which firmly holds the base of the candle 11, and an internal cavity, which contains the circuit assembly 12. The electronic circuit assembly 12 contains an integrated circuit unit (ICU) 17, a battery 18, a switch mechanism 20 and a speaker 22, as further discussed below. Typically, the housing 14 is fabricated from an inexpensive disposable material such as a thermoplastic polymer, e.g., polyethylene, polyvinyl chloride, polyporpylene, polystyrene and the like. An example of candle-flame activatable electronic device and a safety device therefor is further disclosed in U.S. patent application Ser. No. 08/037,302, filed on Mar. 26, 1993, now U.S. Pat. No. 5,363,590 which in its entirety is herein incorporated by reference.

The present safety device 5 is placed intimately above the candle holding section of the candle-flame activatable electronic device 10. The safety device 5 comprises a elongated hollow structure that is fabricated from a nonflammable material. The peripheral or circumferenetial contour of the inside wall of the safety device 5 generally conforms to the peripheral shape of the base portion of the candle 11. Desirably, the contour of the inside wall tightly conforms to the peripheral shape of the base portion of the candle 11. The term "base portion" as used herein indicates the base end or the lower portion around the base end of a candle.

The safety device of the present invention can be fabricated from any nonflammable material. Suitable nonflammable materials include metal, e.g., aluminum, steel, iron, brass, copper, lead, and the like as well as blends thereof; ceramics; glass; high temperature plastics, e.g., polycyclohexylene dimethylene terephthalate; flame-retarded plastics, e.g., tin heat-stabilizer modified polyolefins, polyamides, polyvinyl chloride, polyesters and the like; metal-foils; metal-foil laminated papers; flame-retarded papers and the like. The safety device can be produced by machining a block or tube of a nonflammable material, or molding a molten metal or thermoplastic polymer into a desired shape. Alternatively, if a malleable material, e.g., a metal sheet or foil, is employed, a strip of the malleable material can be wrapped around the candle at least once to shape it into the safety device having a desired hollow structure. Optionally, the outer end of the wrapped strip can be folded or adhesively attached to prevent the wrapped strip from becoming unwrapped inadvertently. In addition, the thickness of the safety device can vary widely. However, the thickness of the safety device should be sufficient enough to support the weight of the molten candle wax which will form in and near the safety device when the candle flame reaches the safety device. Desirably, the thickness of the safety device is at least about 1/64 of an inch, more desirably at least about 1/32 of an inch.

Figure 2:
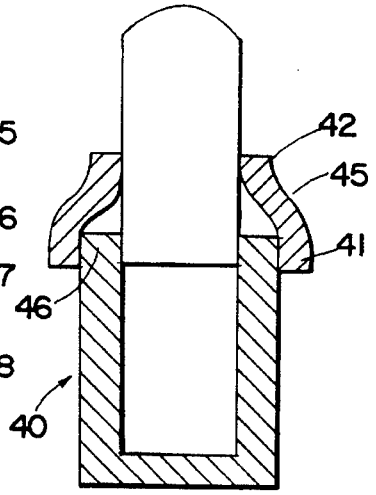
Figure 3:
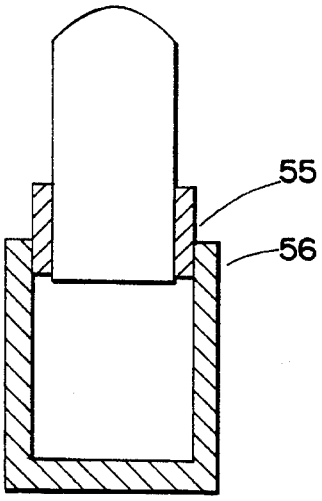
Figure 4:
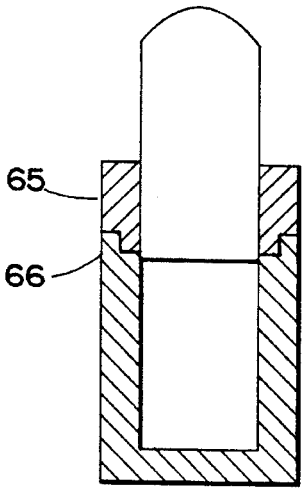

As a preferred embodiment of the present invention, the lower end of the safety device is further extended to cover a portion of the candle holding section of the candle-flame activatable electronic device so that the safety device is securely affixed to the electronic device and thus would not accidentally separated from the electronic device. FIGS. 2, 3 and 4 illustrates examples of the preferred embodiment of the present invention. The safety device 45 illustrated in FIG. 2 has an extended lower section 41 which has an average diameter larger than that of the upper portion 42 (the candle conforming portion) of the safety device, and has an inner peripheral configuration that conforms to the outside contour of the candle holding section 46 of the candle-flame activatable electronic device 40. Desirably, the safety device tightly fits over the candle holding section to ensure a secure engagement of the safety device 45 on the electronic device 40. The safety device 55, illustrated in FIG. 3, has an extended lower section which has an outer peripheral configuration that confirms to at least some portion of the inside contour of the candle holding section 56 such that the safety device 55 is held in position. FIG. 4 illustrates a safety device 65 which has a thinner lower portion so that the thin portion can fit into the candle holding section 66 of the electronic device 60.

Figure 5:
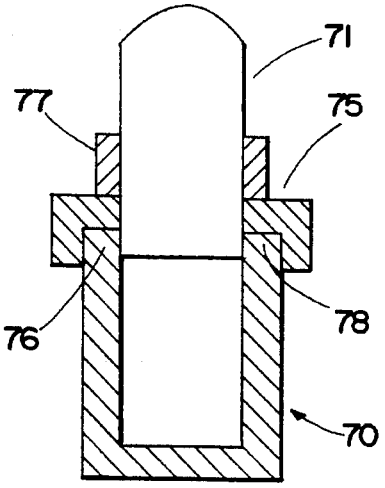

As another alternative embodiment of the present invention, as shown in FIG. 5, the safety device comprises a lower safety portion 75 that is engaged with the candle holding section 76 of the candle-flame activatable electronic device 70 and an upper safety portion 77 of the safety device that is placed intimately atop of the lower safety portion 75. The upper safety portion 77 fits over the base portion of the candle 71 and the lower safety portion 75 is engaged firmly with the candle holding section of the electronic device 70. The lower safety portion completely encloses an upper portion of the candle holding section 76, and optionally, the upper end of the lower safety portion is bent toward the center to cover the upper-most plane 78, i.e., the wall width, of the candle holding section 76, completely covering all of the externally exposed surface of the upper portion of the candle holding section 76.

Figure 6:
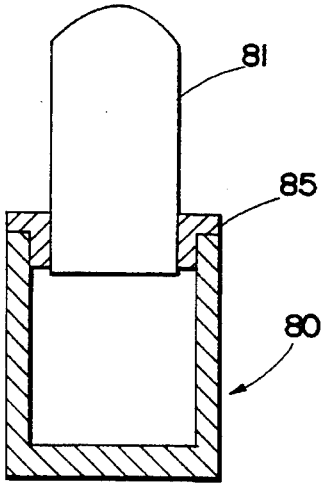

FIG. 6 illustrates yet another embodiment of the present invention. The safety device 85 has a lower portion that fits tightly over the candle 81 to hold the candle in position and a upper portion that is bent outwardly away from the center of the safety device so that the bent upper portion can securely placed over or atop of the candle holding section 86 of the electronic device 80.

In accordance with the present invention the dimensions of the safety device can be varied widely to accommodate different shapes of candles and the candle holding section of the electronic devices. Preferably, the length-to-diameter ratio, i.e., the ratio obtained by dividing the longitudinal length of the safety device by the average diameter of the inner wall of the safety device, is at least about 0.5, more preferably at least about 0.75 and most preferably at least about 1. In general, a safety device having a large length-to-diameter ratio is more efficient. Additionally, although the safety device can be utilized for any size candle, preferably the device is used for candles having an average diameter equal to or less than about 1 inch, more preferably equal to or less than about ½ inches, and most preferably equal to or less than about ⅜ inches.

Now returning to FIG. 1, the electronic circuit assembly 12 comprises an integrated circuit unit (ICU) 17, a battery 18, a switch mechanism 20 and a speaker 22. The circuit of the electronic circuit assembly 12 is complete and closed except for the switch mechanism 20 so that when the switch mechanism 20 is closed, the electronic circuit assembly 12 is activated.

Figure 7:
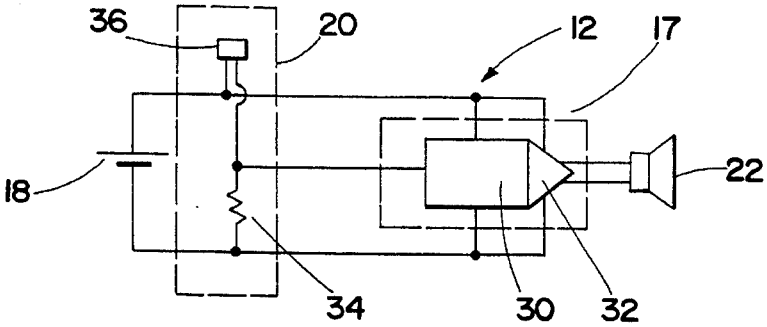
FIG. 7 illustrates an exemplary integrated circuit that is suitable for a musical candle.

The ICU 17 contains a memory stage 30, which is more closely illustrated in FIG. 7. The memory stage 30 contains preprogrammed electronic signals that are converted to audible sounds or messages by the speaker 22 when the switch mechanism 20 is closed, activating the ICU 17 and thus the electronic circuit unit 12. The ICU 17 contains programmed instructions to play one or more cycles of preprogrammed electronic signals once the switch mechanism 20 is closed to activate the ICU 17. The program in the ICU 17 preferably is a program that completes the preprogrammed cycle or that repeats a number of cycles even when the switch mechanism is opened before the completion of the programmed cycle. However, different needs for different uses or occasions may require that the playing duration of the electronic signals programmed in the ICU 17 corresponds to the closing duration and sequence of the switch mechanism. Additionally, if there is a specific requirement to have the electronic signals from the ICU 17 and, correspondingly, the auditory message therefrom respond to the closing sequence and duration of the switch mechanism, it may be desirable to program the ICU 17 to reset itself to the initial stage of its programmed cycle when the switch mechanism opens after each use.

The ICU 17 may also contain an amplifier 32 that amplifies the electronic signals from the ICU, if a loud audible response is desired. The power source 18, i.e., a battery, is selected to properly accommodate the requirements of the electronic circuit assembly 12, including the ICU 17. In accordance with the convention of the relevant electronic circuit art, the preferred ICU has 1.5 volt circuitries and, correspondingly, the preferred power source potential is 1.5 volt.

In accordance with the present invention, any switch mechanism that detects the candle-flame and thus activates the ICU can be employed. For example, the switch mechanism 20 comprises a resistor 34 and a candle-flame detector 36. The resistor 34 is connected between the power source 24 and the memory stage 30, and the detector 36 is placed in series with the resistor 34 with respect to the power source 24. As mentioned above, the electronic circuit assembly 12 is a closed circuit except for the switch mechanism 20, more particularly the detector 36. The detector 36 can be any mechanism known in the art that detects the candle-flame. For example, U.S. Pat. No. 5,015,175 to Lee discloses a musical candle having a switch mechanism that is controlled by a piezoelectric strip that is placed along the wick of the candle that is a part of a musical candle and is consumed or burned along with the wick. When the piezoelectric strip is heated by the flame of the candle, it allows the electrical current to flow and thus completes the circuit of the ICU, activating the musical program encoded in the ICU. U.S. Pat. No 4,477,249 to Ruzek et al. discloses an alternative switching mechanism for a musical candle. Ruzek et al. utilizes a flammable optical filament which is placed along the wick of the candle to transmit the intense light of the burning candle-flame and a photo-sensitive switch which receives the optical filament. The photo-sensitive switch closes the circuit of the musical ICU when it detects the light of candle-flame through the optical filament. Yet another switching mechanism is disclosed in U.S. Pat. No. 4,568,269 to Lin. Lin discloses another switching mechanism for a musical candle which comprises a pair of insulated electric conductors, e.g., wires that are arranged along the wick of the candle. When the candle is lit, the insulation of the conductors are burned to melt and fuse together to form a closed electric connection, activating the musical ICU. These three U.S. Patents are herein incorporated by reference.

As is well known in the art, integrated circuit units (ICUs) suitable for the present invention may be programmed with various musical tones and/or voice messages. And these ICUs are commercially available, for example, Melody IC ERSO 3830 SER. Such suitable ICUs are conventional and within the current state of the relevant art; consequently, no further description of the ICU is disclosed herein.

The safety device of the present invention extinguishes the candle flame when the flame reaches the safety device, thereby preventing the flame from burning the electronic device and/or overheating the battery contained in the electronic device. In addition, the safety device can decorated, e.g, painted, embossed or engraved, to enhance the appearance of the electronic device, e.g, a musical candle.

The present invention is further described with the following examples. The examples are provided for illustration purposes and are not intended to limit the scope of the present invention thereto.

EXAMPLES

Musical candles of the type illustrated in FIG. 1, were used to test the present safety device. A number of the housings for the musical candles were molded from polyethylene and polyvinyl chloride. It has been found that the choice of polymer for the housing did not influence the outcome of the examples since both polymers were flammable. The housing of the musical candles was produced to hold a round cylindrical candle having a 5/16 inch diameter, and the housing had a wall thickness of about 1/32 inches. Two types of the safety device were produced. One safety device (SD One) was the device illustrated in FIG. 2, which had a total length of about 10/16 of an inch and a thickness of about 1/32 of an inch. The safety device had equal length upper and lower sections, and the upper section was fabricated to firmly hold the candle and the lower section was fabricated to conform to the candle holding section of the housing. The other safety device (SD Two) was the lower portion of the safety device illustrated in FIG. 5 that conforms to and covers the candle holding section of the musical candle. The length of SD Two was about 5/16 of an inch and the thickness was about 1/32 of an inch. Five musical candles that were fitted with SD One, five musical candles that were fitted with SD Two and five musical candles did not have any safety device were prepared. These musical candles were lit and allowed to burn.

The SD One safety device extinguished the candle-flame of all five musical candles when the flame reached the safety device, and there was no visible thermal damage to all of the housing of the musical candles. The candle-flame of all five musical candles with SD Two were also extinguished by the SD Two safety device when the flame reached the safety device, although the candle holding section of two of the five musical candles having SD Two were distorted by the heat generated by the candle flame when it reached the safety device. In contrast, all five of the musical candle without the safety device were set afire when the flame reached the candle holding section, and the flame had to be manually extinguished. The results of the examples clearly demonstrates that the importance and efficacy of the present safety device.

What is claimed is:

1. A safety device for a candle-flame activatable electronic device, said electronic device being enclosed in a flammable housing and said housing having a candle housing section that holds a candle, wherein said safety device comprises a nonflammable elongated hollow structure which has an upper and a lower section and two open ends, said upper and lower sections having an inner surface and an outer surface, wherein the contour of said inner surface of said upper section conforms to the circumferential contour of said candle and the contour of said inner surface of said lower section conforms to the outer circumferential contour of said candle holding section.

2. The safety device of claim 1 wherein said device is fabricated from a nonflammable material selected from the group consisting of metals, ceramics, glass, high temperature plastics, flame-retarded plastics, metal-foils, metal-foil laminated papers and flame-retarded papers.

3. The safety device of claim 1 wherein said device is fabricated from aluminum.

4. The safety device of claim 1 wherein said device has a length-to-diameter ratio of at least about 0.5, wherein the diameter for said ratio is the average diameter of said inner surface of said hollow structure.

5. The safety device of claim 1 wherein said device has a length-to-diameter ratio of at least about 1.

6. The safety device of claim 1 wherein said device is used for said electronic device that uses a candle having an average diameter equal to or less than about 1 inch.

7. The safety device of claim 5 wherein said device is used for said electronic device that uses a candle having an average diameter equal to or less than about 3/8 of an inch.

8. The safety device of claim 1 wherein said device has a thickness at least about 1/64 of an inch.

9. A safety device for a candle-flame activatable electronic device, said electronic device being enclosed in a flammable housing and said housing having a candle holding section that holds a candle, wherein said safety device comprises a nonflammable elongated hollow structure which has an upper and a lower section and two open ends, said upper and lower sections having an inner surface and an outer surface, wherein the contour of said inner surface of said upper section conforms to the circurmferential contour of said candle and the contour of said outer surface of said lower section conforms to the inner circumferential contour of said candle holding section.

10. The safety device of claim 9 wherein said device is fabricated from a nonflammable material selected from the group consisting of metals, ceramics, glass, high temperature plastics, flame-retarded plastics, metal-foils, metal-foil laminated papers and flame-retarded papers.

11. The safety device of claim 9 wherein said device is fabricated from aluminum.

12. The safety device of claim 9 wherein said device has a length-to-diameter ratio of at least about 1, wherein the diameter for said ratio is the average diameter of said inner surface of said hollow structure.

13. The safety device of claim 12 wherein said device is used for said electronic device that uses a candle having an average diameter equal to or less than about ⅜ of an inch.

14. The safety device of claim 9 wherein said device has a thickness at least about 1/64 of an inch.

* * * * *